United States Patent [19]

Breitmoser et al.

[11] Patent Number: 4,491,557

[45] Date of Patent: Jan. 1, 1985

[54] METHOD FOR PERMANENTLY CONNECTING DISCRETE STRUCTURAL PARTS

[75] Inventors: Georg Breitmoser, Groebenzell; Wilhelm Vogel, Aystetten, both of Fed. Rep. of Germany

[73] Assignee: MTU Motoren-und Turbinen-Union München GmbH, Munich, Fed. Rep. of Germany

[21] Appl. No.: 522,644

[22] Filed: Aug. 11, 1983

[30] Foreign Application Priority Data

Aug. 14, 1982 [DE] Fed. Rep. of Germany ..... 3230377

[51] Int. Cl.[3] ..... B22F 3/10

[52] U.S. Cl. ..... 419/5; 29/157.4; 29/726

[58] Field of Search ..... 419/5; 29/157.4, 726

[56] References Cited

U.S. PATENT DOCUMENTS

| | | | |
|---|---|---|---|
| 4,009,234 | 2/1977 | Erlandson et al. | 264/24 |
| 4,447,389 | 5/1984 | Bruce | 419/5 |

FOREIGN PATENT DOCUMENTS

| | | | |
|---|---|---|---|
| 677533 | 1/1964 | Canada | 419/5 |
| 2155955 | 11/1971 | Fed. Rep. of Germany | 419/5 |
| 937573 | 9/1963 | United Kingdom | 419/5 |
| 1408145 | 10/1975 | United Kingdom . | |

*Primary Examiner*—Leland A. Sebastian

*Attorney, Agent, or Firm*—W. G. Fasse; D. H. Kane, Jr.

[57] ABSTRACT

In a method for undetachably interconnecting discrete structural parts by means of a connecting or bonding material, the structural parts which are to be interconnected are arranged in an aligned manner in a hollow mold, and the interspaces between the hollow mold and the structural parts are filled with a sinterable metal powder. After the arrangement is heated to the sintering temperature of the metal powder, a sintered body results with at least partially embedded, rigidly interconnected structural parts, due to a diffusion bonding. Heat exchanger blocks may especially be produced according to such a method in a simple manner, without requiring that the separate structural parts must be premachined for an exact shape accuracy.

14 Claims, 6 Drawing Figures

METHOD FOR PERMANENTLY CONNECTING DISCRETE STRUCTURAL PARTS

BACKGROUND OF THE INVENTION

The invention relates to a method for undetachably interconnecting discrete structural parts with the aid of a bonding material, and to a heat exchanger block produced according to this method.

In the prior art, known methods of making undetachable connections are soldering, welding and gluing. In most instances, the structural parts which are to be interconnected are interconnected with the aid of an additive such as solder, welding rods, adhesive with or without heating.

The connection surfaces of geometrically difficult structural parts must first be adapted or matched to each other, prior to the soldering, welding, or gluing. Depending on the construction and requirements of the structural parts, this calls for maintaining very narrow tolerance limits at the connection site (e.g., ±0.05 mm). This requires an exact shape accuracy and hence an expensive machining of the structural parts to be interconnected, for instance, by turning, milling, boring, or eroding.

A sinter-connecting method is know in the art, however, it is comparatively involved and expensive. The metal powder must first be presintered into a briquette, and then the metal part which is to be inserted is connected to the briquette in a second sintering operation (CH-Pat. No. 263,725).

OBJECTS OF THE INVENTION

It is the object of the invention to provide a method for undetachably interconnecting discrete structural parts of the above mentioned type, in which machining for an exact shape accuracy with comparatively tight tolerances of the structural parts to be interconnected is not necessary, yet, with the aid of which a rigid, undetachable interconnection between the parts may be produced by simple means.

Furthermore, it is an object of the invention to produce a heat exchanger block by the method of the invention.

SUMMARY OF THE INVENTION

This object is achieved by the method according to the invention of the above mentioned type, in that the structural parts to be interconnected are arranged in an aligned manner in a hollow mold, and the spaces between the hollow mold and the structural parts are filled at least with a sinterable metal powder layer, whereupon the hollow mold, including the structural parts and the metal powder, is heated to the sinter temperature of the chosen metal powder and then is allowed to cool.

In contrast to the above mentioned prior art, in the invention the sintering-in of the structural parts is achieved in a single work operation through the use of a highly heat resistant metal powder and in fact without compression, that is, without any external pressure influence.

Particularly, the structural parts which are rigidly interconnected by the sintered metal powder are again removed from the hollow mold.

According to a further embodiment of the invention, the hollow mold including the inserted structural parts and the metal powder may be heated under vacuum to the sinter temperature.

A subsequent compression may suitably be carried out after a sintering operation, for a better consistency of the interconnected body.

The structural parts to be connected are at least partially coated with a metal spray layer before being arranged aligned relative each other in the hollow mold, so that the structural parts are held with a (small) spacing from each other in the mold. Thereby it is ensured that interstices occur, which may be filled with sinterable metal powder. Simultaneously it is ensured that no fretting or frictional corrosion will arise on the structural parts.

Structural parts which are connected by a sintered body are in many instances not fully embedded and thereby not completely interconnected by the sintered body. After the removal of the sinterconnected structural parts from the hollow mold, an outer supporting frame may advantageously be utilized for supporting the structural parts, especially at non-sintered connection spots, whereby they are stabilized by the supporting frame. In order to avoid a fretting corrosion between the supporting frame and the inner structural parts, an outer support frame is coated before it is used, on its inner circumference with a metal spray layer. The supporting frame may be constructed as one piece, or it may be assembled from several assembly parts.

An especially advantageous method according to the invention is characterized in that a non-sinterable powder is put into the mold before tubular structural parts to be connected are arranged in the hollow mold, and in that the open pipe ends of the tubular structural parts, which are in a rigid arrangement, are pushed into the non-sinterable powder. Then the sinterable metal powder is placed on top of the non-sinterable powder whereafter the sintering takes place. The non-sinterable powder avoids an undesirable penetration of sintering material into the hollow spaces of the structural parts.

If a slight shrinkage during sintering is desired, the temperature-time-program may be correspondingly chosen. The metal powder thus does not sinter gas-tight. In this case, according to an advantageous further embodiment of the method of the invention, a soldering foil suitably may be applied to achieve sealing with the aid of the soldering foil.

The sinterable metal powder suitably has a particle size of approximately 150 $\mu$. Thereby, even small spaces or interstices between the rigidly arranged structural parts may be filled. The powder composition, that is, the grain size distribution, is chosen so that a bulk density results which is at least 75% of the theoretical density to minimize shrinkage.

The metal powder can be more quickly and reliably brought into the desired spaces, if it is suspended in an organic liquid (e. g., alcohol, hexane) before being brought into the mold, and is then introduced into the hollow mold as a slurry.

Therefore, by means of the invention a rigid, undetachable connection between structural parts to be interconnected, is achieved by simple means, by which the structural parts do not require any exact shape-machining, yet which are interconnected exactly to each other. The structural parts are usually placed and fixed in a hollow mold such as a ceramic bowl of $Al_2O_3$. Then the interstices between the parts are filled with the metal powder. Due to the small particle size of the sinterable metal powder even the smallest interstices in the ceramic bowl may be reached and utilized for a connecting function. After the structural parts are fixed in position in the metal powder, the actual sintering is carried out, that is, the parts are heated to the sintering temperature in a or without a vacuum (depending on the metal). A compact sintered body or mass is formed from the metal powder, whereby the structural parts placed therein remain unchanged in their form and position. An undetachable connection is achieved with the sintered mass ("diffusion bonding"). If desired or required, the entire sintered body may then be compressed. The outer shape of the finished body is defined by the inside shape of the ceramic bowl, which may be selected according to needs. In order to, for instance, keep the inner diameter of a tubular structural part clear, the bottom surface of the ceramic bowl is lined with a neutral powder (e.g., $Al_2O_3$). According to the method of the invention, a heat exchanger block of which the heat exchange pipes or lancets are rigidly connected by a sintered body, may be especially easily produced. Udimet powder may preferably be used as the sinterable metal powder.

BRIEF FIGURE DESCRIPTION

In the following the invention will be described in more detail, by way of example embodiments and with reference to the drawings, wherein.

DETAILED DESCRIPTION OF PREFERRED EXAMPLE EMBODIMENTS AND OF THE BEST MODE OF THE INVENTION

Figure 1:
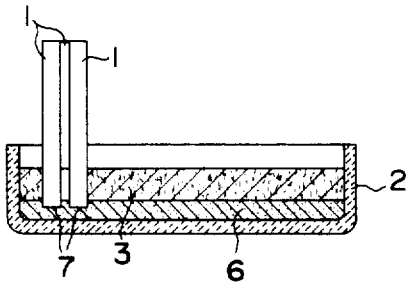
FIG. 1 is a schematic section through a hollow mold utilized according to the invention, with inserted connecting parts.

In FIG. 1 a hollow mold 2 in the form of a ceramic bowl is shown in a schematic sectional view. The ceramic bowl is made, for instance, of SiC or $Al_2O_3$.

A non-sinterable ("sinter-neutral") powder 6, for example $Al_2O_3$ is in the ceramic bowl 2.

The (tubular) structural parts 1 to be interconnected, are inserted from above into the hollow form 2, which is open on top and closed on the sides, whereby the lower open pipe ends 7 of the structural parts 1 are pushed into the sinter-neutral powder 6. The structural parts which have been inserted in the mold are aligned with each other in the desired manner with the aid of position determining jigs which are not shown in FIG. 1.

Figure 2:
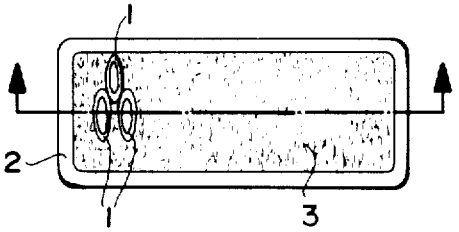
FIG. 2 is a schematic cross-section of the arrangement of FIG. 1 at the level of the sinterable metal powder layer.

Then the sinterable metal powder 3 is filled into the hollow form 2, whereby all the interspaces between the inserted structural parts 1 are filled. Since the open ends of the structural parts 1 stick into the sinter-neutral powder 6, inner hollow spaces of the structural parts 1 remain unfilled, as may be seen for instance, in FIG. 2.

The fixed structural parts together with the outer hollow mold 2 and the powder layers 6 and 3 according to the arrangement of FIG. 1, are now heated to sintering temperature whereby the metal powder layer 3 (in contrast to the sinter-neutral powder 6) is sintered. A sintered body with rigidly embedded structural parts 1 results due to a diffusion bonding. If desired, a subsequent compression is carried out.

Then the outer hollow mold 2 and the still powdered layer 6 are removed.

Figure 3:
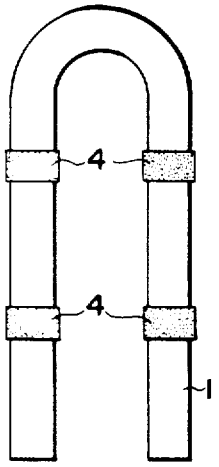
FIG. 3 is a schematic side view of a special structural part in the form of a cooling tube which is to be connected according to the invention.

A heat exchanger block, which comprises structural parts 1 in the form of cooling tubes according to FIG. 3, may be produced especially according to the connecting method of the invention. The individual cooling tubes are provided at upper and lower spots with a circumferential metal spray layer 4, so that cooling tubes which are packed close to each other are held at a (small) distance apart, whereby interspaces result, which may be filled with sinterable powder. The metal spray coating of the cooling tubes further assures that the structural parts are not subject to a fretting corrosion.

Figure 4:
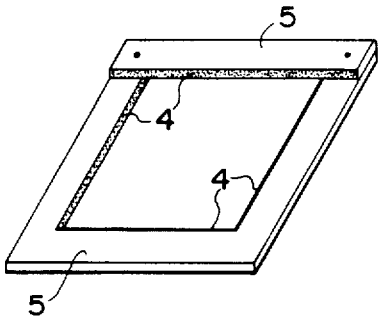
FIG. 4 is a schematic perspective view of an individual item used in practicing the invention.

FIG. 4 shows in a perspective schematic view an outer supporting frame 5, of which the inner circumference is provided with a metal spray layer 4 similar to the metal spray coating according to FIG. 3. The outer supporting frame 5 serves for stabilizing a sintered heat exchanger block comprising several structural parts, for example, cooling tubes according to FIG. 3. Preferably, the outer supporting frame 5 serves to secure the structural part arrangement according to FIG. 1 in an upper girth range, that is at a position at which the structural parts 1 are not connected to each other by the sintered metal powder layer 3.

Figure 5:
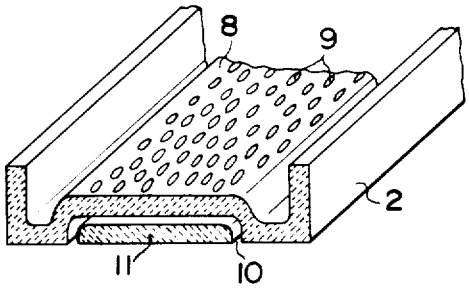
FIG. 5 is a perspective view of a particular construction of a hollow mold.

FIG. 5 shows a hollow laterally open frame 2 in a schematic perspective view. The hollow frame 2 comprises a raised inner region 8 with a plurality of openings 9, through which the lower ends of structural parts 1 to be connected, may be inserted. The arrangement of the openings 9 determines the final position of the structural parts which are to be connected.

The raised inner region 8 of the hollow mold 2 made of ceramic, is so constructed in its cross-section that a longitudinal channel 10 results underneath, in which a (slidable) ceramic rail 11 is arranged. The ceramic rail 11 serves as a length stop for the structural parts 1 which have been pushed through the openings 9 of the raised region.

It will be noted that the hollow mold 2 according to FIG. 5 serves for the production of a heat exchanger block with a rectangular collector pipe corresponding to the cross-sectional shape of the raised inner region 8 of the mold.

Figure 6:
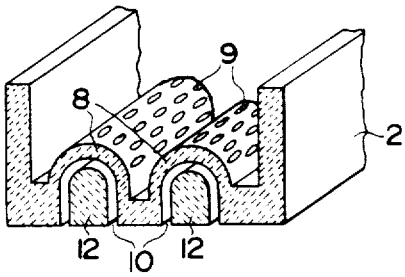
FIG. 6 is a perspective view of a further construction of a hollow mold for carrying out the method of the invention.

The hollow mold 2, a partial zone of which is shown perspectively in FIG. 6 in the area of the part, comprises two raised inner regions 8 with openings 9, whereby lower longitudinal channels 10 are provided, in which ceramic rods 12 are inserted. The ceramic rods 12 correspond basically to the ceramic rails 11 of FIG. 5. It will be noted that the arrangement according to FIG. 6 makes possible the production of a heat exchanger block with (two) round collector pipes.

Although the invention has been described with reference to specific example embodiments, it will be appreciated that it is intended to cover all modifications and equivalents within the scope of the appended claims.

We claim:

1. A method for undetachably interconnecting discrete structural parts with the aid of a bonding material, comprising the following steps: arranging the structural parts (1) which are to be interconnected in an aligned manner in a hollow mold (2) to form an assembly, filling the interspaces between the hollow mold (2) and the structural parts (1) with at least one sinterable metal powder layer (3), heating the hollow mold (2) together with the structural parts and the metal powder to the sinter temperature of said metal powder for sintering said metal powder, and then cooling said assembly.

2. The method of claim 1, further comprising removing said structural parts (1), which are rigidly interconnected by the sintered metal powder (3) without an external pressure application, from the hollow mold (2).

3. The method of claim 1 wherein said heating step of the hollow mold (2) together with the inserted structural parts (1) and the metal power (3), to said sinter temperature is performed under vacuum.

4. The method of claim 1, further comprising performing a subsequent compression after the sintering.

5. The method of claim 1, further comprising coating at least partially said structural parts (1) which are to be interconnected, with a metal spray layer (4), prior to aligning said structural parts with each other in the hollow mold (2).

6. The method of claim 1, further comprising stabilizing the structural parts (1), which are to be interconnected by sintering, by an outer supporting frame (5).

7. The method of claim 6, further comprising coating an inner circumference of the outer supporting frame (5) with a metal spray layer (4) before said outer supporting frame is being used.

8. The method of claim 1, further comprising placing a non-sinterable powder (6) into the mold before pipe-shaped structural parts (1) which are to be interconnected are arranged in the hollow mold (2), and inserting the open pipe ends (7) of the pipe-shaped structural parts which are in a rigid arrangement, into the non-sinterable powder (6).

9. The method of claim 1, further comprising placing a gas-tight soldering foil on the metal powder layer (3) before sintering.

10. The method of claim 1, further comprising using a powdered sinter metal having a particle size of approximately 150? as the metal powder (3).

11. The method of claim 1, further comprising suspending the metal powder (3) in an organic liquid to form a slurry before the metal powder is put into the mold, and then filling the slurry into the hollow mold (2).

12. A method for manufacturing a heat exchanger block having at least one collector pipe and a plurality of interconnected tubular members having open ends operatively connected to said collector pipe, comprising the following steps: arranging said tubular members in a hollow mold in an aligned manner, said hollow mold having a bottom forming at least part of a negative configuration of said collector pipe, filling the hollow mold with a quantity of sinterable metal material to form a layer for interconnecting said tubular members and for forming at least a wall portion of said collector pipe, while simultaneously avoiding entry of the sinterable metal material into said open ends of said tubular members, heating the hollow mold together with the tubular members and the sinterable metal material to the sinter temperature of said sinterable metal material for sintering said sinterable metal material thereby simultaneously interconnecting said tubular members and forming at least said wall portion of said collector pipe, and removing said hollow mold from the heat exchanger block.

13. The method of claim 12, wherein a powder is used as said sinterable metal material.

14. The method of claim 12, wherein a slurry is used as said sinterable metal material.

* * * * *

UNITED STATES PATENT AND TRADEMARK OFFICE

CERTIFICATE OF CORRECTION

PATENT NO. : 4,491,557

DATED : January 1, 1985

INVENTOR(S) : Georg Breitmoser, Wilhelm Vogel

It is certified that error appears in the above—identified patent and that said Letters Patent is hereby corrected as shown below:

Claim 10, line 3 (Column 6) "150?" should read --150μ--.

Signed and Sealed this

*Eleventh* Day of *June 1985*

[SEAL]

*Attest:*

DONALD J. QUIGG

*Attesting Officer*

*Acting Commissioner of Patents and Trademarks*